US011919686B1

(12) United States Patent
Jackson et al.

(10) Patent No.: US 11,919,686 B1
(45) Date of Patent: Mar. 5, 2024

(54) CONTAINER FOR LIQUID STORAGE BAG

(71) Applicant: Packaging Corporation of America, Lake Forest, IL (US)

(72) Inventors: Keith A. Jackson, Round Lake, IL (US); Nicholas A. Philips, Sugar Grove, IL (US)

(73) Assignee: Packaging Corporation of America, Lake Forest, IL (US)

( * ) Notice: Subject to any disclaimer, the term of this patent is extended or adjusted under 35 U.S.C. 154(b) by 4 days.

(21) Appl. No.: 17/657,438

(22) Filed: Mar. 31, 2022

Related U.S. Application Data

(60) Provisional application No. 63/170,406, filed on Apr. 2, 2021.

(51) Int. Cl.

| | |
|---|---|
| ***B65D 5/468*** | (2006.01) |
| ***B65D 5/02*** | (2006.01) |
| ***B65D 5/54*** | (2006.01) |
| ***B65D 5/74*** | (2006.01) |
| ***B65D 77/06*** | (2006.01) |

(52) U.S. Cl.
CPC ..... *B65D 5/4608* (2013.01); *B65D 5/0227* (2013.01); *B65D 5/74* (2013.01); *B65D 77/065* (2013.01); *B65D 5/542* (2013.01)

(58) Field of Classification Search
CPC . B65D 5/60; B65D 5/606; B65D 5/46; B65D 5/4608; B65D 5/48088
USPC ..... 229/117.27, 117.3, 117.13, 117.16
See application file for complete search history.

(56) References Cited

U.S. PATENT DOCUMENTS

| | | | | |
|---|---|---|---|---|
| 3,109,577 | A * | 11/1963 | Knipp | B65D 5/5435 229/145 |
| 4,168,003 | A * | 9/1979 | Wysocki | B65D 5/742 229/217 |
| 5,197,625 | A * | 3/1993 | Mullaney | B65D 5/541 229/162.6 |
| 6,237,840 | B1 * | 5/2001 | Grabowski | B65D 5/46088 229/150 |
| 7,090,115 | B2 * | 8/2006 | Pierce | B65D 5/029 229/109 |
| 7,377,420 | B2 * | 5/2008 | Gardner | B65D 5/327 229/122.34 |
| 8,025,208 | B2 * | 9/2011 | Wisecarver | B65D 5/10 222/105 |

(Continued)

OTHER PUBLICATIONS

Bag-in-Box Container—2019.

*Primary Examiner* — Nathan J Newhouse
*Assistant Examiner* — Phillip D Schmidt
(74) *Attorney, Agent, or Firm* — Klarquist Sparkman, LLP

(57) ABSTRACT

A container for housing a liquid-filled bag has at least four walls including first and second side walls, a front wall, and a back wall. The front wall has a front wall panel, and the back wall has a back wall panel interconnected with first and second side wall panels. A first inner shield flap is coupled to the front wall panel, a second inner shield flap is coupled to the back wall panel, and a first top flap is coupled to the first side wall panel. The first top flap defines a first handhold opening. A second top flap is coupled to the second side wall panel and defines a second handhold opening. The first and second handhold openings overlap to define a handhold when the second top flap is folded over the first top flap. The handhold is offset from free ends of the first and second inner shield flaps.

29 Claims, 13 Drawing Sheets

(56) References Cited

U.S. PATENT DOCUMENTS

| | | | | |
|---|---|---|---|---|
| 10,919,680 | B1 | 2/2021 | Philips | |
| 2009/0283579 | A1* | 11/2009 | Kelly | B65D 5/4608 229/117.3 |
| 2020/0255204 | A1* | 8/2020 | Belgya | B65D 5/542 |
| 2021/0053719 | A1* | 2/2021 | Baner | B65D 5/54 |

* cited by examiner

CONTAINER FOR LIQUID STORAGE BAG

CROSS REFERENCE TO RELATED APPLICATION

The present application claims the benefit of U.S. Provisional Application No. 63/170,406, filed Apr. 2, 2021, which is incorporated herein by reference in its entirety.

FIELD

The present disclosure pertains to containers configured to receive liquid-containing bags or bladders for shipment and/or storage.

BACKGROUND

Shipment of liquids, such as beverages or other liquid products, can be problematic. Glass containers must be carefully packed in relatively large quantities of packaging, which often include polymeric foam materials, plastic film air bladders, and the like, which are not recyclable and increase cost. Bags and bladders intended to contain and dispense liquids are an attractive alternative. However, existing containers for holding such bags suffer from a number of disadvantages. Accordingly, there exists a need for improved containers for holding and transporting liquid-containing bags and bladders.

SUMMARY

Certain embodiments of the disclosure pertain to containers configured to receive liquid-containing bags or bladders for shipment and/or storage. In a representative embodiment, a container for housing a liquid-filled bag with a spout comprises a container bottom, and at least four walls extending upwardly from the container bottom, the at least four walls including first and second side walls, a front wall, and a back wall. The front wall comprises a removable portion configured to define a spout-receiving opening when the removable portion is removed. The front wall and the back wall are opposed and spaced apart from each other along a length dimension of the container. The first side wall comprises a first side wall panel, and the second side wall comprises a second side wall panel. The front wall comprises a front wall panel, and the back wall comprises a back wall panel, the back wall panel being interconnected with the first and second side wall panels. A first inner shield flap is coupled to the front wall panel, a second inner shield flap is coupled to the back wall panel, and a first top flap is coupled to the first side wall panel, the first top flap defining a first handhold opening. A second top flap is coupled to the second side wall panel, the second top flap defining a second handhold opening. The second handhold opening and the first handhold opening overlap to define a handhold when the second top flap is folded over the first top flap, and the handhold is offset from free end portions of the first and second inner shield flaps along the length dimension of the container.

In any or all of the disclosed embodiments, the first and second inner shield flaps have different lengths such that the free end portions of the first and second inner shield flaps are closer to the front wall than to the back wall, or closer to the back wall than to the front wall.

In any or all of the disclosed embodiments, the first inner shield flap is longer than the second inner shield flap such that the free end portions of the first and second inner shield flaps are closer to the back wall than to the front wall.

In any or all of the disclosed embodiments, the handhold is closer to the front wall than to the back wall.

In any or all of the disclosed embodiments, the handhold is closer to the back wall than to the front wall.

In any or all of the disclosed embodiments, the handhold overlays the first inner shield flap, the first inner shield flap comprises a free distal edge, and a distance between the free distal edge of the first inner shield flap and an edge of the handhold nearest to the free distal edge of the first inner shield flap is 0.75 inch or more.

In any or all of the disclosed embodiments, the front wall panel is an inner front wall panel, the container further comprises an outer front wall panel coupled to the second side wall panel and overlapping the inner front wall panel, and the outer front wall panel comprises a removable portion configured to expose the inner front wall panel when removed.

In any or all of the disclosed embodiments, the outer front wall panel further comprises a first side portion secured to the inner front wall panel and a second side portion secured to the inner front wall panel, and the removable portion of the outer front wall panel is between the first side portion of the outer front wall panel and the second side portion of the outer front wall panel.

In any or all of the disclosed embodiments, the first side portion and the second side portion of the outer front wall panel are adhered to the inner front wall panel, and the removable portion of the outer front wall panel is not adhered to the inner front wall panel.

In any or all of the disclosed embodiments, the outer front wall panel comprises a first perforated line between the first side portion and the removable portion of the outer front wall panel, and a second perforated line between the second side portion and the removable portion of the outer front wall panel.

In any or all of the disclosed embodiments, the first perforated line and the second perforated line are angled relative to a longitudinal axis of the outer front wall panel.

In any or all of the disclosed embodiments, the removable portion of the outer front wall panel comprises a grip portion at a top edge of the removable portion of the outer front wall panel.

In any or all of the disclosed embodiments, the removable portion of the outer front wall panel comprises a fold line extending across a width of the removable portion of the outer front wall panel.

In any or all of the disclosed embodiments, a width of the removable portion of the outer front wall panel is 25% or more of a width of the outer front wall panel.

In any or all of the disclosed embodiments, a width of the first side portion is 0.75 inch or more, and wherein a width of the second side portion is 0.75 inch or more.

In any or all of the disclosed embodiments, the container is wrapped in a polymeric film.

In another representative embodiment, a container for housing a liquid-filled bag with a spout comprises a container bottom, and at least four walls extending upwardly from the container bottom, the at least four walls including first and second side walls, a front wall, and a back wall. The front wall and the back wall are opposed and spaced apart from each other along a length dimension of the container. The first side wall comprises a first side wall panel, and the second side wall comprises a second side wall panel. The front wall comprises an inner front wall panel coupled to the first side wall panel, and an outer front wall panel coupled to the second side wall panel and overlapping the inner front wall panel, the inner front wall panel comprising a removable portion configured to define a spout-receiving opening when removed. The back wall comprises a back wall panel, the back wall panel being interconnected with the first and second side wall panels. The outer front wall panel comprises a removable portion configured to expose the inner front wall panel when removed.

In any or all of the disclosed embodiments, the outer front wall panel further comprises a first side portion secured to the inner front wall panel and a second side portion secured to the inner front wall panel, and the removable portion of the outer front wall panel is between the first side portion of the outer front wall panel and the second side portion of the outer front wall panel.

In any or all of the disclosed embodiments, the first side portion and the second side portion of the outer front wall panel are adhered to the inner front wall panel, and the removable portion of the outer front wall panel is not adhered to the inner front wall panel.

In any or all of the disclosed embodiments, the outer front wall panel comprises a first perforated line between the first side portion and the removable portion of the outer front wall panel, and a second perforated line between the second side portion and the removable portion of the outer front wall panel.

In any or all of the disclosed embodiments, the first perforated line and the second perforated line are angled relative to a longitudinal axis of the outer front wall panel.

In any or all of the disclosed embodiments, the removable portion of the outer front wall panel comprises a grip portion at a top edge of the removable portion of the outer front wall panel.

In any or all of the disclosed embodiments, the removable portion of the outer front wall panel comprises a fold line extending across a width of the removable portion of the outer front wall panel.

In any or all of the disclosed embodiments, a width of the removable portion of the outer front wall panel is 25% or more of a width of the outer front wall panel.

In any or all of the disclosed embodiments, a width of the first side portion is 0.75 inch or more, and wherein a width of the second side portion is 0.75 inch or more.

In any or all of the disclosed embodiments, the container further comprises a first inner shield flap coupled to the inner front wall panel, a second inner shield flap coupled to the back wall panel, a first top flap coupled to the first side wall panel, the first top flap defining a first handhold opening, and a second top flap coupled to the second side wall panel, the second top flap defining a second handhold opening, wherein the second handhold opening and the first handhold opening overlap to define a handhold when the second top flap is folded over the first top flap, and wherein the handhold is spaced apart from free end portions of the first and second inner shield flaps along the length dimension of the container.

In another representative embodiment, a container for housing a liquid-filled bag with a spout comprises a container bottom, and at least four walls extending upwardly from the container bottom, the at least four walls including first and second side walls, a front wall, and a back wall. The front wall and the back wall are opposed and spaced apart from each other along a length dimension of the container. The first side wall comprises a first side wall panel, and the second side wall comprises a second side wall panel. The front wall comprises an inner front wall panel coupled to the first side wall panel, and an outer front wall panel coupled to the second side wall panel and overlapping the inner front wall panel, the inner front wall panel comprising a removable portion configured to define a spout-receiving opening when removed. The back wall comprising a back wall panel, the back wall panel being interconnected with the first and second side wall panels, a first inner shield flap coupled to the inner front wall panel, and a second inner shield flap coupled to the back wall panel. A first top flap is coupled to the first side wall panel, the first top flap defining a first handhold opening. A second top flap coupled to the second side wall panel, the second top flap defining a second handhold opening. The second handhold opening and the first handhold opening overlap to define a handhold when the second top flap is folded over the first top flap, and the handhold is offset from free end portions of the first and second inner shield flaps along the length dimension of the container. The outer front wall panel comprises a removable portion configured to expose the inner front wall panel when removed.

The foregoing and other objects, features, and advantages of the disclosed technology will become more apparent from the following detailed description, which proceeds with reference to the accompanying figures.

DETAILED DESCRIPTION

The present disclosure pertains to containers configured to house an internal liquid container, such as a polymeric bag or bladder with a spout, commonly referred to as a "bag-in-box" system. The containers disclosed herein can be particularly suited for storage and/or shipment of liquid-filled bags containing, for example, beverages such as wine, soft drink syrup, household cleaning products, etc., in the context of online retail and e-commerce. The containers can also be used in combination with liquid containers having rigid walls. Embodiments of the containers described herein include a handhold formed in the top of the container which is offset longitudinally from the free end portions of the inner closure flaps (also referred to as shield flaps) located beneath the handhold. Thus, when a user grips the handhold, the inner shield flaps can prevent the user's hand from contacting the liquid-containing bag inside the container. The distance between the handhold and the free ends of the shield flaps can be configured such that a user cannot easily reach through the gap between the free distal ends of the shield flaps to touch the liquid bag.

Certain embodiments of the containers described herein can also include a front wall comprising overlapping inner and outer front wall panels. The inner front wall panel can comprise a removable portion or panel configured to form an opening to receive the spout of the liquid bag, and a locking tab to hold the spout in place. The outer front wall panel can comprise a removable portion or "zipper panel," which can be defined between a pair of spaced apart perforated lines. The removable portion of the outer front wall panel can be removed by tearing along the perforated lines to expose at least a portion of the inner front wall panel behind the outer front wall panel. In certain embodiments, side portions of the outer front wall panel (e.g., outward of the removable portion toward the side edges of the outer front wall panel) can be secured (e.g., adhered) to the inner front wall panel, while the removable portion of the outer front wall panel is not secured to the inner front wall panel. Thus, in certain embodiments the side portions of the outer front wall panel can remain attached to the inner front wall panel when the removable portion of the outer front wall panel is removed. The outer front wall panel can thereby provide structural support and rigidity to the front wall of the container, and protection for the removable panel of the inner front wall panel during shipment. The removable portion of the outer front wall panel can be removed by the consumer to access the spout of the liquid bag inside the container.

Figure 1:
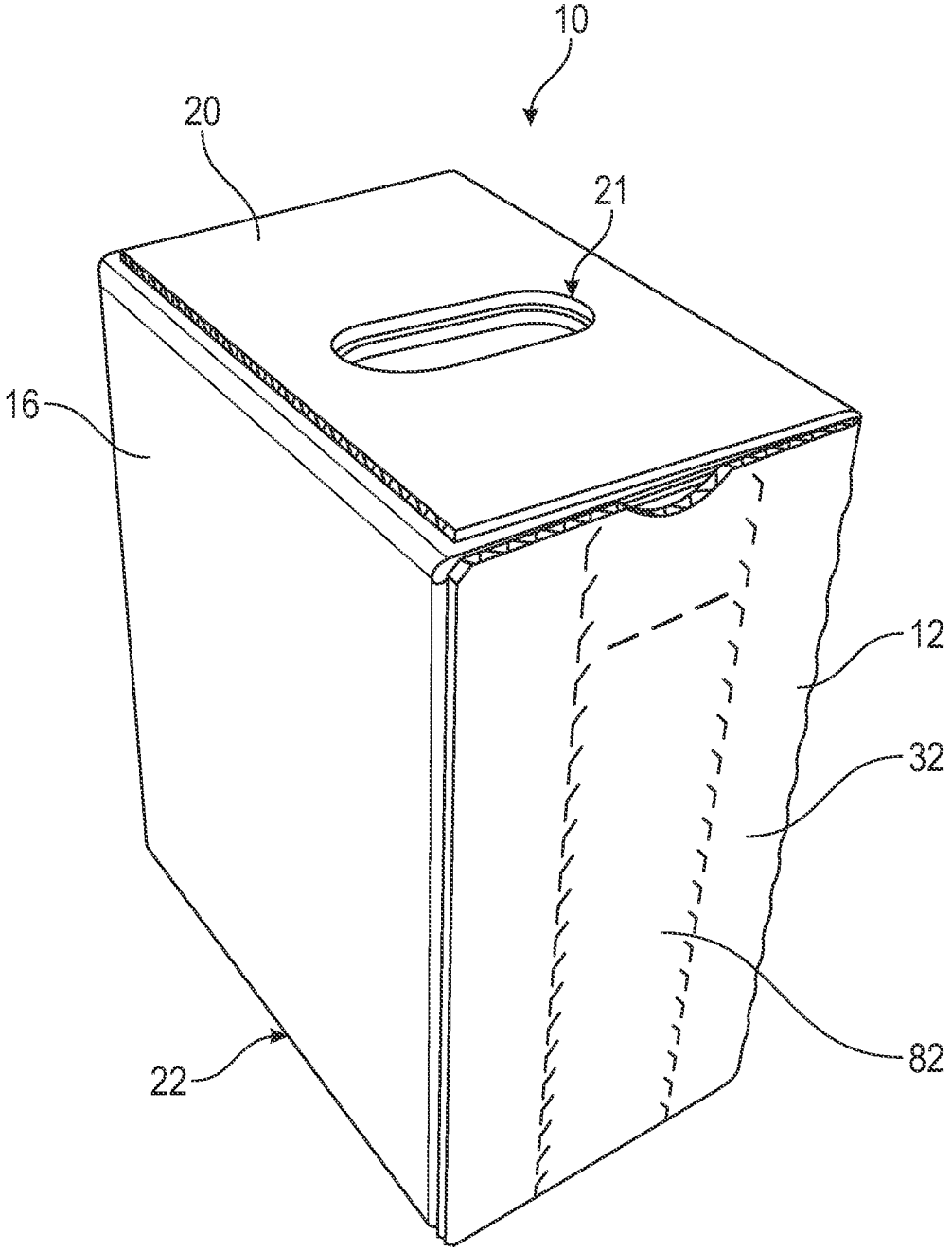
FIG. 1 is a perspective view of a container configured to house a liquid-containing bag with a spout, according to one embodiment.

FIG. 1 illustrates a representative embodiment of a container 10 in which a liquid container, such as a bag with a spout, can be positioned for transport and storage. The container can include at least four walls, including a front wall 12, a back wall 14 (FIG. 4), a first or left side wall 16, a second or right side wall 18 (FIG. 4), a top 20, and a bottom 22. The walls 12, 14, 16, and 18 can extend upwardly from the container bottom 22. The container can comprise a handhold 21, which in the illustrated embodiment can be formed by one or a plurality of coaxially aligned openings defined in the top panels of the container as further described below.

The illustrated container 10 can be made of a variety of materials. However, in certain embodiments the container 10 can be made from corrugated paperboard having one or more face sheets with a corrugated or fluted layer therebetween.

Figure 2:
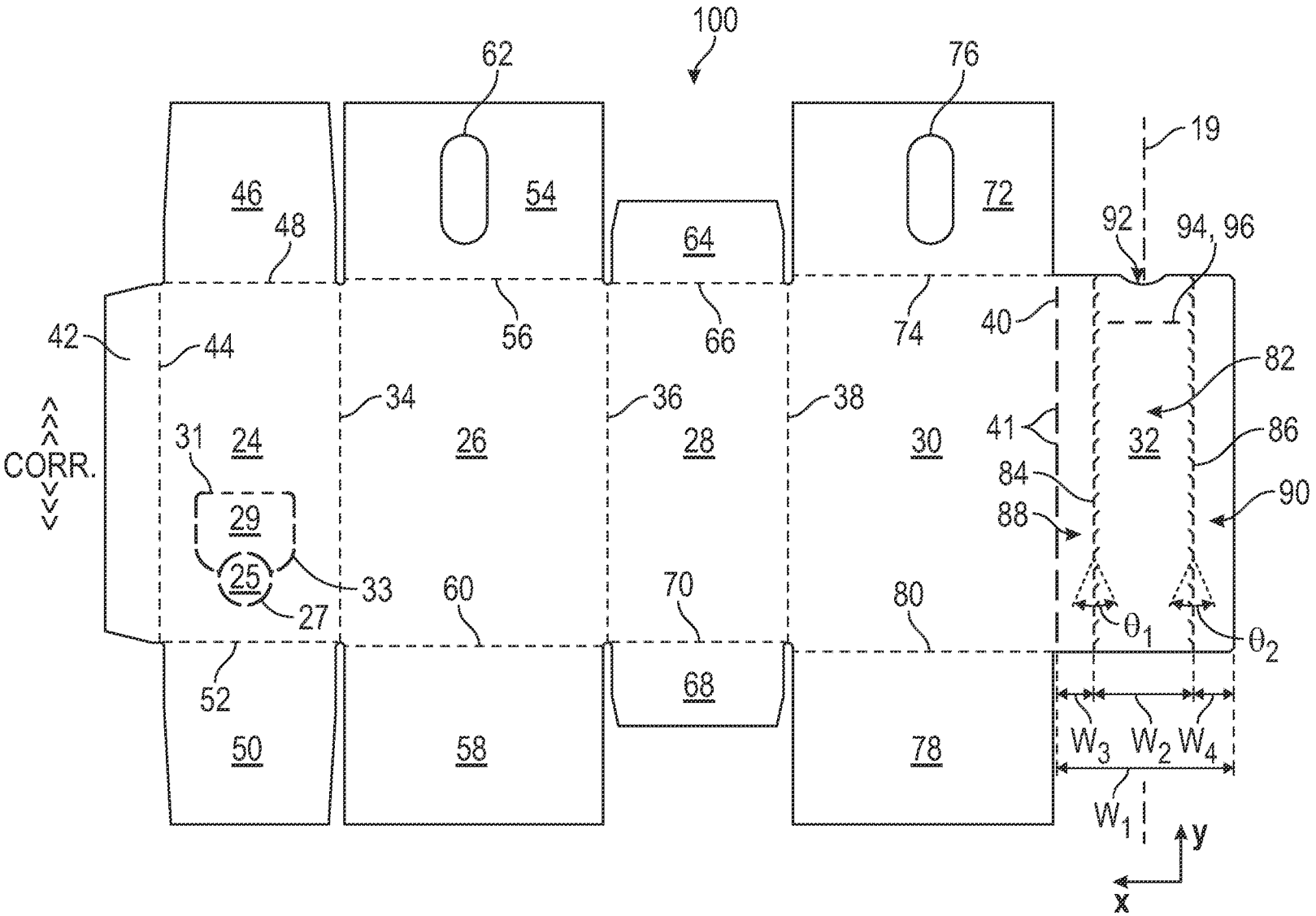
FIG. 2 is a schematic diagram of a blank for forming the container of FIG. 1.

FIG. 2 illustrates a representative example of a blank 100 from which the container 10 can be erected. Desirably, the blank 100 can be a one piece unitary blank, although in certain embodiments components included in the illustrated blank can be separate pieces that are interconnected to form the blank. The blank 100 can comprise a plurality of main wall panels coupled together, including a first or inner front wall panel 24, a second or left side wall panel 26, a third or back wall panel 28, a fourth or right side wall panel 30, and a fifth or outer front wall panel 32. The panels 24, 26, 28, 30, and 32 can be coupled together at respective fold lines 34, 36, 38, and 40. The fold lines 34-40 are represented as dashed lines in FIG. 2. In certain embodiments, the fold line 40 can include scores 41 (e.g., cuts that extend through the exterior face sheet of the corrugated board but not through the corrugated layer beneath it) to facilitate folding the outer front wall panel 32 around the front of the box. A tab member 42 can be coupled to the inner front wall panel 24 at a fold line 44. In the illustrated embodiment, the corrugations of the corrugated paperboard can extend along the y-axis in FIG. 2, but in other embodiments the corrugations can extend along the x-axis depending upon the particular characteristics sought.

In the illustrated embodiment, the inner front wall panel 24 can include a removable portion or panel 25, also referred to as an access portion or access panel. The removable portion 25 can be circular (or any other shape), and when removed can create an opening configured to receive a spout of a liquid bag disposed within the container (see FIG. 10). In the illustrated example, the removable portion 25 is defined by a plurality of curved perforations or knife cuts 27. In certain embodiments, the inner wall panel 24 can also include a partially detachable locking portion 29 located above the circular removable portion 25. The locking portion 29 can be coupled to the inner front wall panel 24 at a fold line 31 along its top edge, and can be defined by a plurality of perforations or knife cuts 33 extending from the fold line 31.

Figure 11:
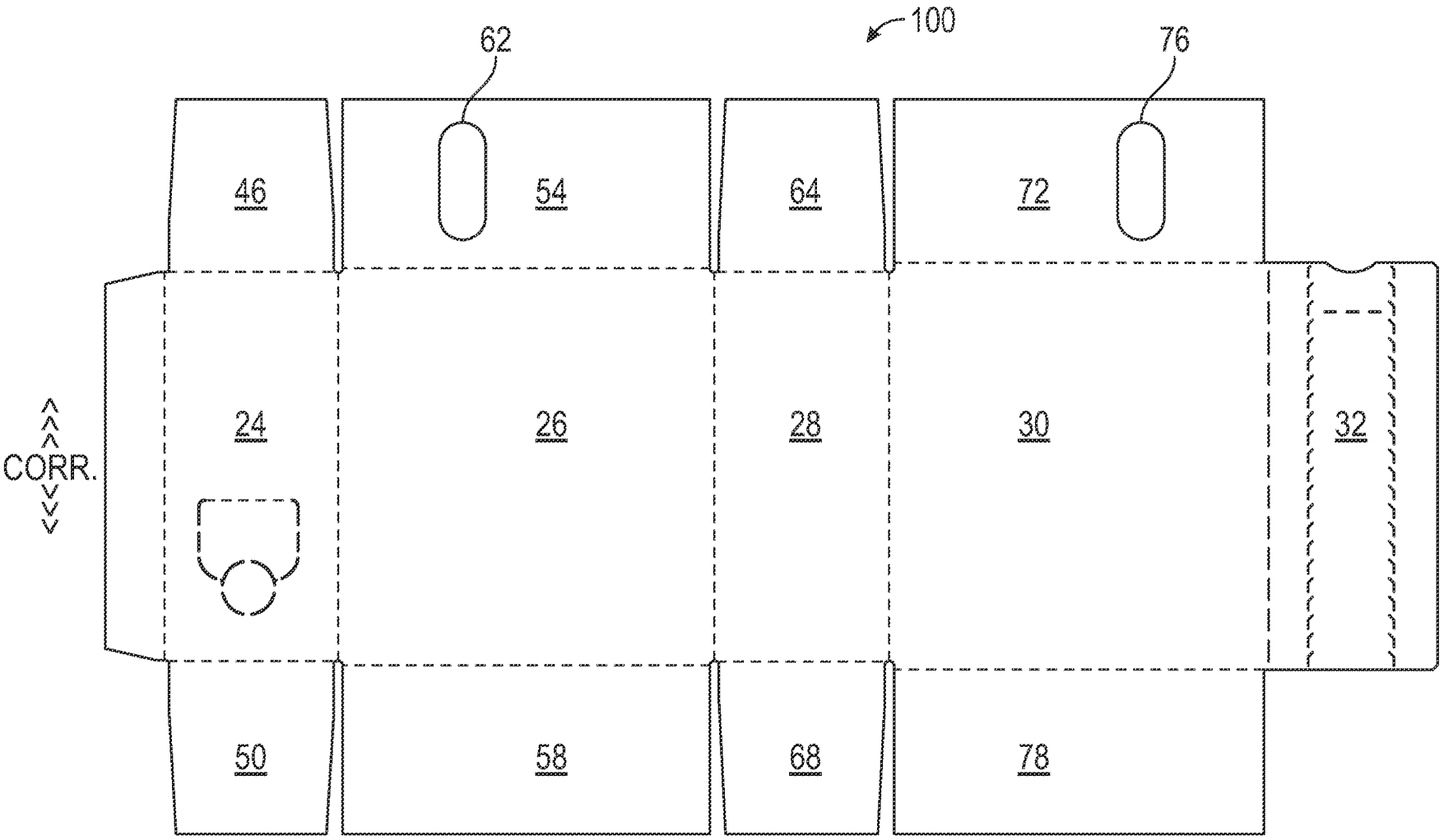
FIG. 11 is a schematic diagram of a blank in which the first and second inner shield flaps are the same length.

A first inner shield flap 46 can be coupled to the inner front wall panel 24 at a fold line 48, and a first bottom flap 50 can be coupled to the inner front wall panel 24 at a fold line 52. Continuing to the right in FIG. 2, a first or inner top flap 54 can be coupled to the left side wall panel 26 at a fold line 56, and a second bottom flap 58 can be coupled to the left side wall panel 26 at a fold line 60. The first or inner top flap 54 can define a handhold opening 62. A second inner shield flap 64 can be coupled to the back wall panel 28 at a fold line 66, and a third bottom flap 68 can be coupled to the back wall panel 28 at a fold line 70. A second or outer top flap 72 can be coupled to the right side wall panel 30 at a fold line 74. The outer top flap 72 can define a handhold opening 76. In certain embodiments, the handhold openings 62 and 76 can be located at or near the center of the respective panels 54 and 72 as in FIG. 2, or can be offset toward the forward edge or rearward edge (e.g., to the left or the right in FIG. 2), as shown in FIG. 11 and discussed further below. A fourth bottom flap 78 can be coupled to the right side wall panel 30 at a fold line 80. In the illustrated embodiment, the first inner shield flap 46 can be longer than the second inner shield flap 64. The first bottom flap 50 can also be longer than the third bottom flap 68. When erected, the bottom flaps 50, 58, 68, and78 can overlap to form the container bottom 22.

In the illustrated embodiment, the outer front wall panel 32 can comprise a removable portion 82, also referred to as a "zipper panel." In the illustrated embodiment, the removable portion 82 extends along the entire length of the outer front wall panel 32, although in other embodiments the removable portion can extend along any portion of the length of the outer front wall panel. The removable portion 82 can be defined by a pair of spaced apart perforated lines 84 and 86 defined in the outer front wall panel 32. The area between the perforated lines 84 and 86 is thus the removable portion 82. Side portions 88 and 90 of the outer front wall panel 32 extend along respective sides of the removable portion 82 outward of the perforated lines 84 and 86 (e.g., toward the side edges of the outer front wall panel 32).

In the illustrated embodiment, the individual perforations of the perforated lines 84 and 86 are curved inwardly away from the side edges of the outer front wall panel 32, and can be referred to as "J-knife" perforations due to their shape resembling the letter J. In other embodiments, the perforated lines 84 and/or 86 can comprise straight line perforations, or combinations of curved and straight perforations, depending upon the particular properties sought.

In the illustrated embodiment the perforated lines 84 and 86 are straight and extend between the upper edge of the outer front wall panel 32 and the lower edge. However, the perforated lines 84 and/or 86 can also be angled relative to the longitudinal axis 19 of the outer front wall panel 32 along all or a portion of their length, depending upon factors such as the size of the bag spout and the amount of clearance space desired on the sides of the spout. Thus, in certain embodiments, all or a portion of one or both of the perforated lines 84 and/or 86 can be angled up to 20°, such as up to 10°, inwardly or outwardly relative to the longitudinal axis 19 of the outer front wall panel. The angles $\theta_1$ and $\theta_2$ in FIG. 2 schematically illustrate the exemplary angle range of the perforated lines 84 and 86 relative to the straight perforated lines 84 and 86 shown. Thus, in such embodiments the removable portion 82, or a portion thereof (e.g., the lower portion), can flare or widen, or narrow, moving in a direction toward the lower edge of the outer front wall panel 32. In such embodiments, the angles of the adhesive lines 89 and 91 described below can also be varied to correspond with the angle of the perforated lines 84 and 86.

In certain embodiments, the removable portion 82 can be relatively wide. For example, in the embodiment of FIG. 2 the outer front wall panel 32 can comprise a width dimension indicated at $W_1$. The removable portion 82 can have a width dimension $W_2$. In certain embodiments, the width $W_2$ of the removable portion 82 can be 10% or more of the width $W_1$ of the outer front wall panel 32, such as 20% or more of the width $W_1$ of the outer front wall panel 32, 25% or more of the width $W_1$ of the outer front wall panel 32, 30% or more of the width $W_1$ of the outer front wall panel 32, 40% or more of the width $W_1$ of the outer front wall panel 32, 50% or more of the width $W_1$ of the outer front wall panel 32, 20% to 80% of the width $W_1$ of the outer front wall panel 32, 20% to 70% of the width $W_1$ of the outer front wall panel 32, 20% to 60% of the width $W_1$ of the outer front wall panel 32, 20% to 50% of the width $W_1$ of the outer front wall panel 32, 25% to 60% of the width $W_1$ of the outer front wall panel 32, 30% to 70% of the width $W_1$ of the outer front wall panel 32, 30% to 60% of the width $W_1$ of the outer front wall panel 32, 40% to 60% of the width $W_1$ of the outer front wall panel 32, etc. In the embodiment illustrated in FIG. 2, the width $W_2$ of the removable portion 82 is approximately 57% of the width $W_1$ of the outer front wall panel 32. In the embodiment illustrated in FIG. 11 the width $W_2$ of the removable portion 82 is approximately 43% of the width $W_1$ of the outer front wall panel 32.

In certain embodiments the side portions 88 and 90 of the outer front wall panel 32 can comprise respective width dimensions $W_3$ and $W_4$. In certain embodiments, the width of the side portions 88 and 90 can be correlated with the strength of the adhesive bond between the side portions and the inner front wall panel 24. Thus, for example, in certain embodiments the width dimensions $W_3$ and $W_4$ of the side portions 88 and 90 can be 0.5 inch or more, such as 0.75 inch or more, one inch or more, two inches or more, etc. In certain embodiments, the width dimensions $W_3$ and $W_4$ can each be 10% or more of the width dimension $W_1$ of the outer front wall panel 32, 20% or more of the width dimension $W_1$, 30% or more of the width dimension $W_1$, 40% or more of the width dimension $W_1$, 45% or more of the width dimension $W_1$, etc. In a particular embodiment, the width dimension $W_1$ is 5 inches, and the width dimensions $W_3$ and $W_4$ are each 1.5 inches, or 30% of the overall width dimension $W_1$. In certain embodiments, the width dimensions $W_3$ and $W_4$ can be different. For example, in certain embodiments, because the side portion 90 is the free end portion of the outer front wall panel 32, the width dimension $W_4$ of the side portion 90 can be larger than the width dimension $W_3$ of the side portion 88.

In certain embodiments, the outer front wall panel 32 can define a recessed grip portion 92 (e.g., an inwardly curving edge) along its upper edge. In certain embodiments, the removable portion 82 can also include a fold line 94 extending horizontally across the removable portion. The fold line 94 can be located in the upper portion of the removable portion 82 adjacent the grip portion 92, and can be spaced downwardly from the grip portion 92. In certain embodiments, the fold line 94 can include a plurality of perforations or knife cuts 96 to facilitate folding the upper portion of the removable portion 82 along the fold line 94. In the illustrated embodiment, the removable portion 82 is configured to be detached by pulling downwardly along the y-axis in FIG. 2. However, in other embodiments the grip portion 92 and the fold line 94 can be located at the bottom edge of the removable portion such that the removable portion can be detached by pulling upwardly along the y-axis.

Figure 3:
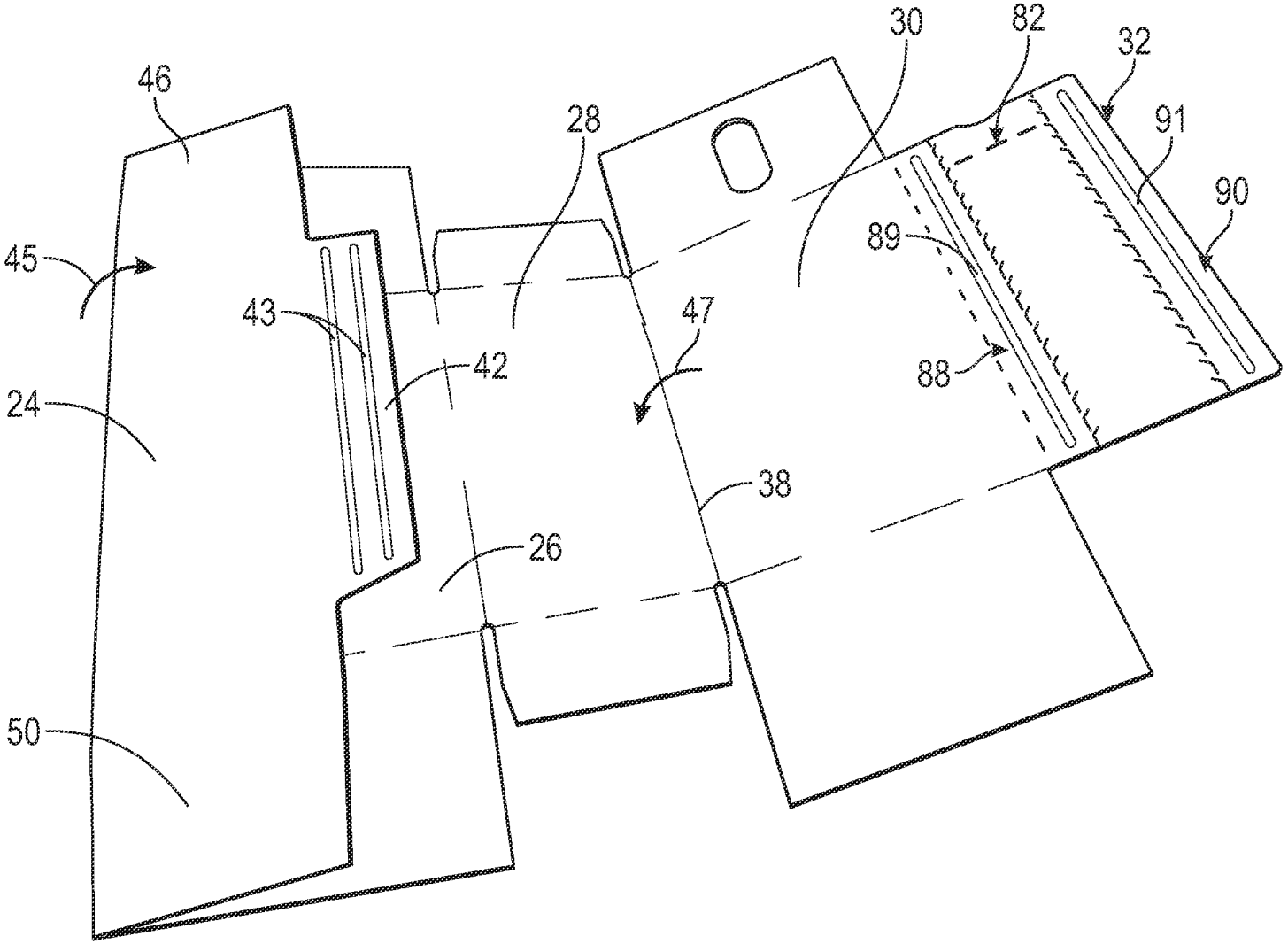
FIG. 3 is a perspective view of a blank for forming the container of FIG. 1.

Referring to FIG. 3, when the container 10 is erected from the blank 100, the inner front wall panel 24 can be folded over 180° as indicated by arrow 45 so that it overlies the left side wall panel 26. Adhesive such as glue can be applied to the upper surface of the tab 42, as indicated by lines 43 in FIG. 3. Adhesive can also be applied to the side portions 88 and 90 of the outer front wall panel 32, as indicated by lines 89 and 91. In certain embodiments, no adhesive is applied to the removable portion 82. Thus, the removable portion 82 is not adhered to the inner front wall panel 24, which can facilitate removal of the portion 82 as described below. In other embodiments, a relatively low strength or low adhesion material such as a gel adhesive material (e.g., gel dots or spots) can be applied to the removable portion 82 depending upon the particular characteristics sought. In certain embodiments, adhesive strips (e.g., a backing material coated with an adhesive) can be used in place of any of the adhesive lines 43, 89, and/or 91 to allow final assembly of the container to be completed by an intermediate user.

Figure 4:
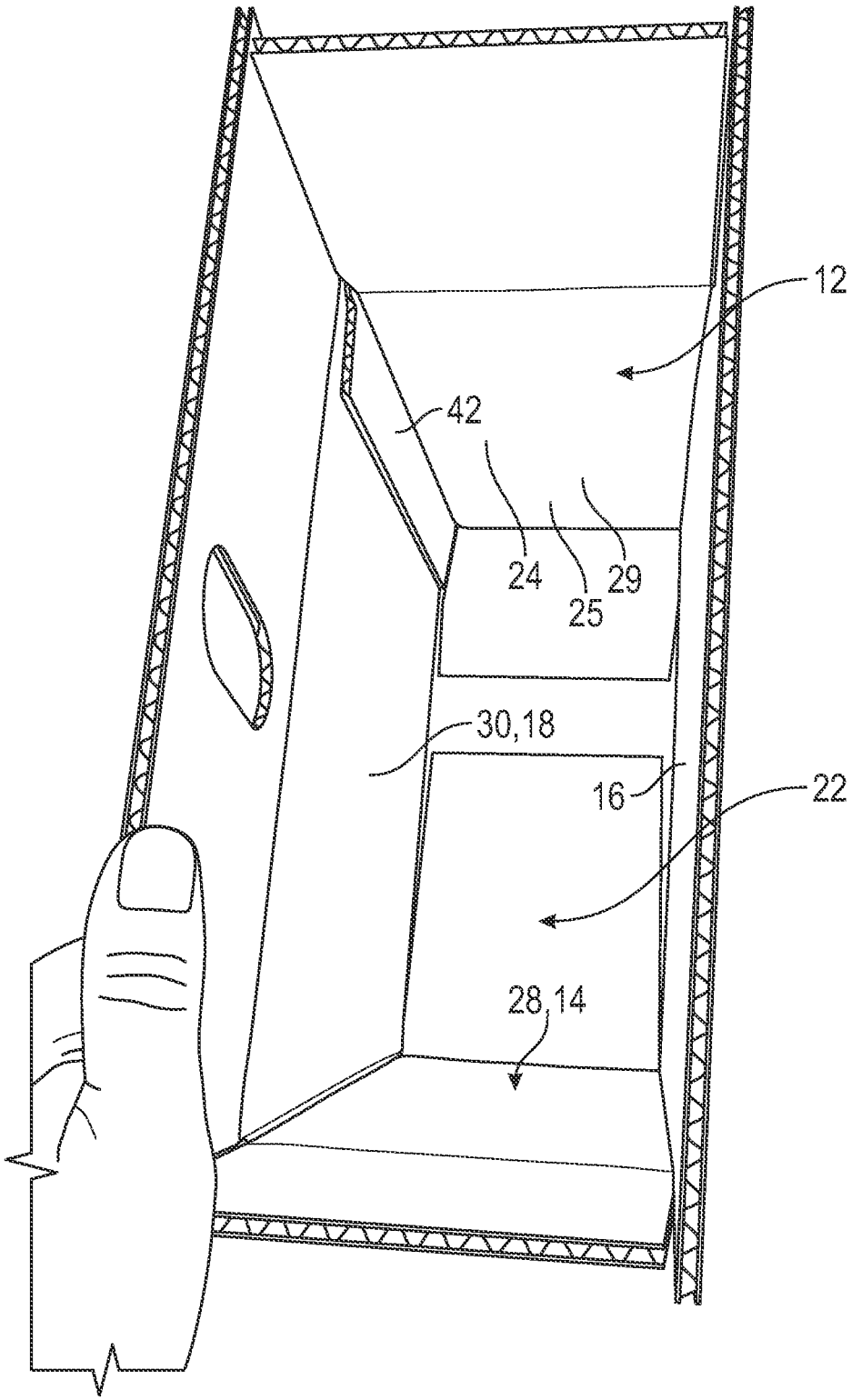
FIGS. 4 and 5 are perspective views of the container of FIG. 1 with the top open.
Figure 5:
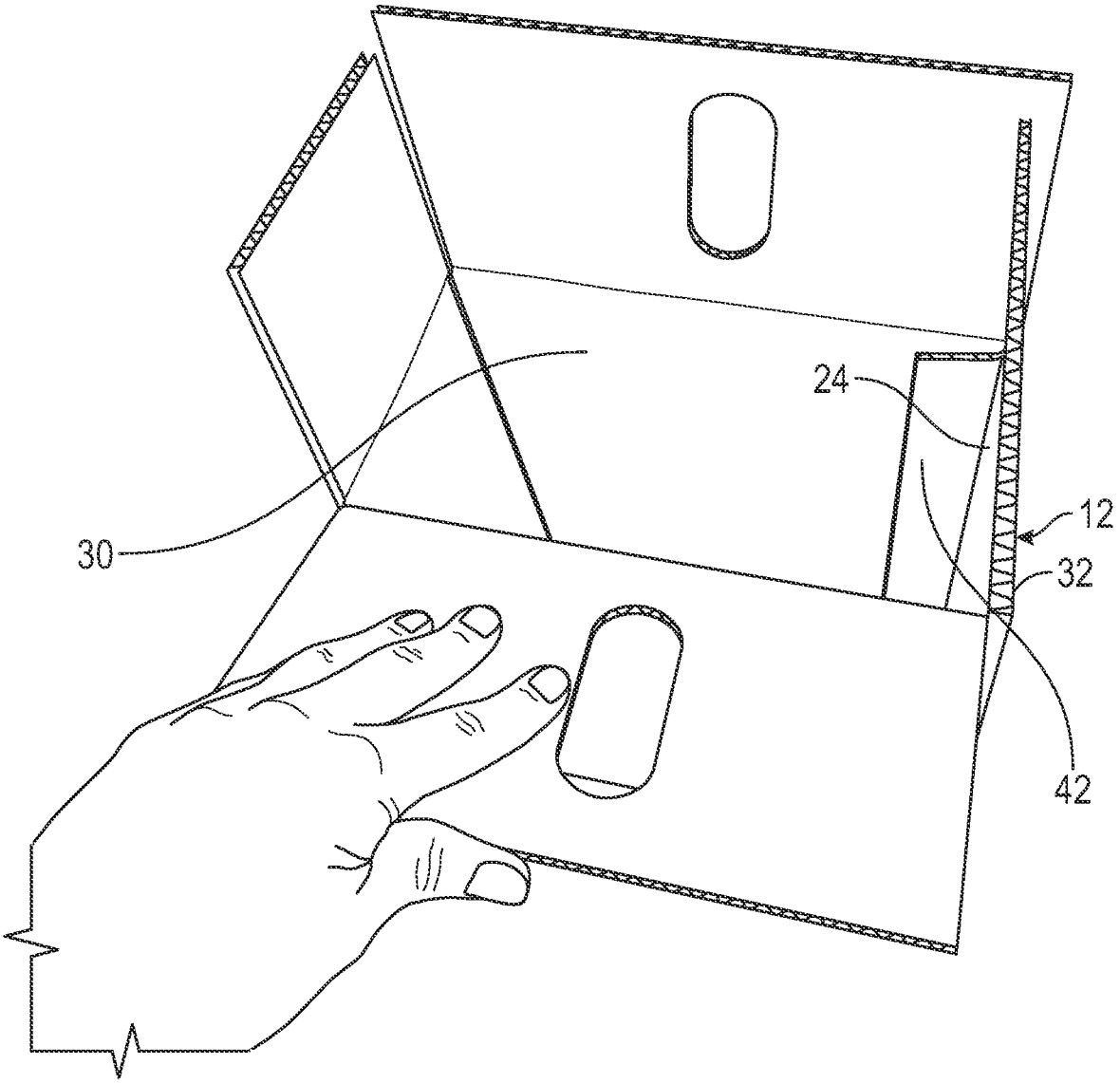

Still referring to FIG. 3, after the adhesive is applied, the right side wall panel 30 can be folded over about the fold line 38 in the direction indicated by arrow 47, and the tab 42 can be secured (e.g., by the adhesive 43) to the inside surface of the right side panel 30. The outer front wall panel 32 can be folded across the inner front wall panel 24 and secured to the inner front wall panel 24 (e.g., by the adhesive lines 89 and 91) such that the outer front wall panel 32 overlays/overlaps the inner front wall panel 24. The result of this step is shown in FIGS. 4 and 5. Thus, with reference to FIGS. 1, 4, and 5, the inner front wall panel 24 and the outer front wall panel 32 can form the front wall 12 of the container. The left side wall panel 26 can form the left side wall 16, the back wall panel 28 can form the back wall 14, and the right side panel 30 can form the right side wall 18. The two-panel construction of the front wall 12 can improve impact resistance and durability, especially of the removable portion 25 and the locking portion 29 of the inner front wall panel 24, which are shielded behind the outer front wall panel 32.

Figure 6:
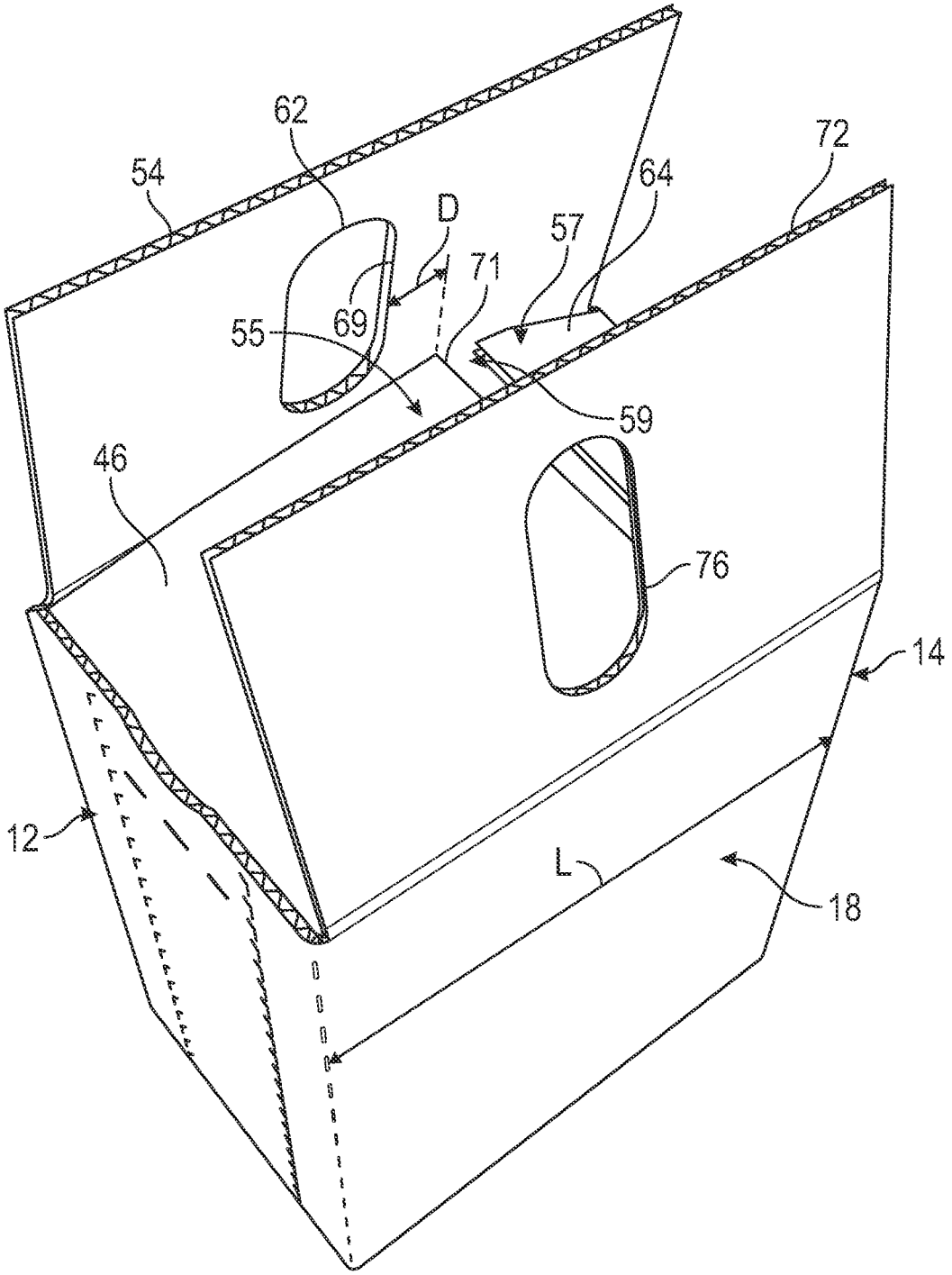
FIG. 6 is a perspective view of the container of FIG. 1 with the inner shield panels lowered into place.

In certain embodiments, the container 10 can be configured such that the handhold 21 is offset from the interface between the first and second inner shield flaps 46 and 64 when the flaps 46 and 64 are folded down in the closed position. Stated differently, the handhold 21 can be offset from the free end portions of the first and second inner shield flaps 46 and 64 along a length dimension L of the container measured between the front wall 12 and the opposed back wall 14 (FIG. 6). In certain embodiments, this can be accomplished by making the first and second inner shield flaps 46 and 64 different lengths such that the free end portions of the flaps 46 and 64 are closer to (e.g., offset toward) either the front wall 12 or the back wall 14. This configuration is described below with reference to FIG. 6. The handhold 21 can also be offset from the free end portions of the first and second inner shield flaps 46 and 64 by locating the handhold openings 62 and 76 toward the forward or rearward edges of the respective flaps 54 and 72 (e.g., offsetting the openings 62 and 76 away from the center of the flaps 54 and 72). This configuration is described below with reference to FIGS. 11 and 12. In certain embodiments, these approaches can be combined wherein the inner shield flaps can have different lengths and the handhold openings can also be offset forward or rearward away from the centers of the respective flaps 54 and 72.

Figure 7:
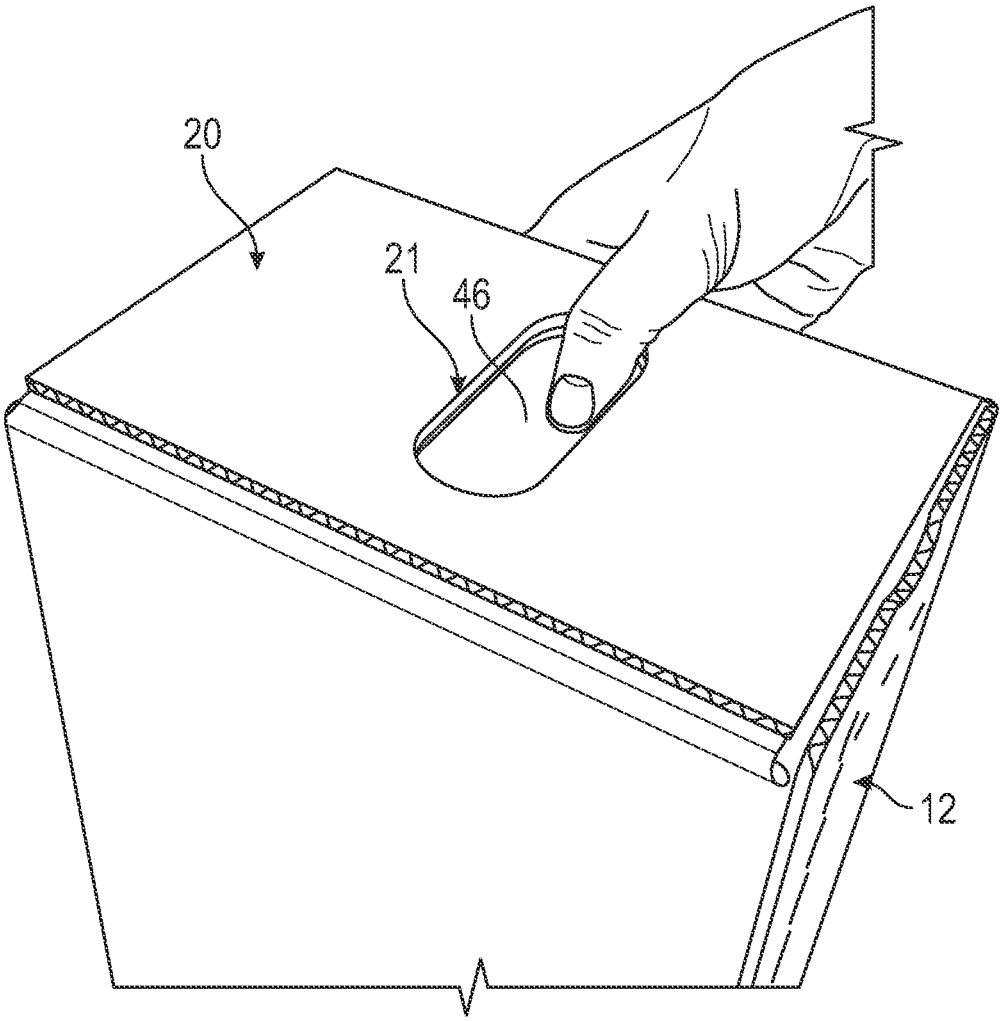
FIG. 7 is a perspective view of an portion of the container of FIG. 1 with the top closed.

As stated above, the first and second inner shield flaps 46 and 64 of the container 10 (blank 100) of FIGS. 1 and 2 are different lengths. FIG. 6 illustrates the container 10 with the top flaps 54 and 72 in the open position, and the inner shield flaps 46 and 64 folded downwardly in the closed position. In the embodiment of FIGS. 1-6, the handhold openings 62 and 76 are located at or near the centers of the respective flaps 54 and 72. As can be seen in FIG. 6, the free end portion 55 of the first inner shield flap 46 and the free end portion 57 of the second inner shield flap 64 are offset from the handhold openings 62 and 76 toward the back wall 14 of the container. More particularly, the edge 69 of the handhold opening 62, which can correspond to the edge of the handhold 21 when the flaps 54 and 72 are folded to the closed position, can be nearest the free distal edge 71 of the first inner shield flap 46. The distance D between the edge 69 of the handhold opening 62 and the free distal edge 71 of the first inner shield flap 46 is indicated in FIG. 6. In certain embodiments, the distance D can be 0.75 inch or more, such as one inch or more, two inches or more, 0.75 inch to three inches, 0.75 inch to two inches, etc. Thus, with reference to FIG. 7, when the outer top flaps 54 and 72 are folded to the closed position and a user inserts their hand into the handhold 21, the user's hand contacts the first inner shield flap 46 and is prevented from directly contacting the liquid bag inside the container. Moreover, it is also difficult or impossible for the user to reach around the free distal edge 71 of the first inner shield flap 46 to touch the liquid bag inside the container.

Returning to FIG. 6, in certain embodiments the first and second inner shield flaps 46 and 64 can be configured such that their free end portions define a gap between the shield flaps when laid flat in the closed position. For example, with reference to FIG. 6, the free end portion 55 of the first inner shield flap 46 can be spaced apart from the free end portion 57 of the second inner shield flap 64 to define a space or gap 59 therebetween. In certain embodiments, the gap 59 can permit the first inner shield flap 46 to pivot downwardly into the box when the handhold 21 is gripped by a user without interference from the second inner shield flap 64. Thus, the first inner shield flap 46 can freely pivot downwardly inside the container to accommodate a user's hand when gripping the handhold 21. In certain embodiments, the width of the gap can be ⅛ inch or more, such as ¼ inch or more, ½ inch or more, one inch or more, etc.

Figure 8:
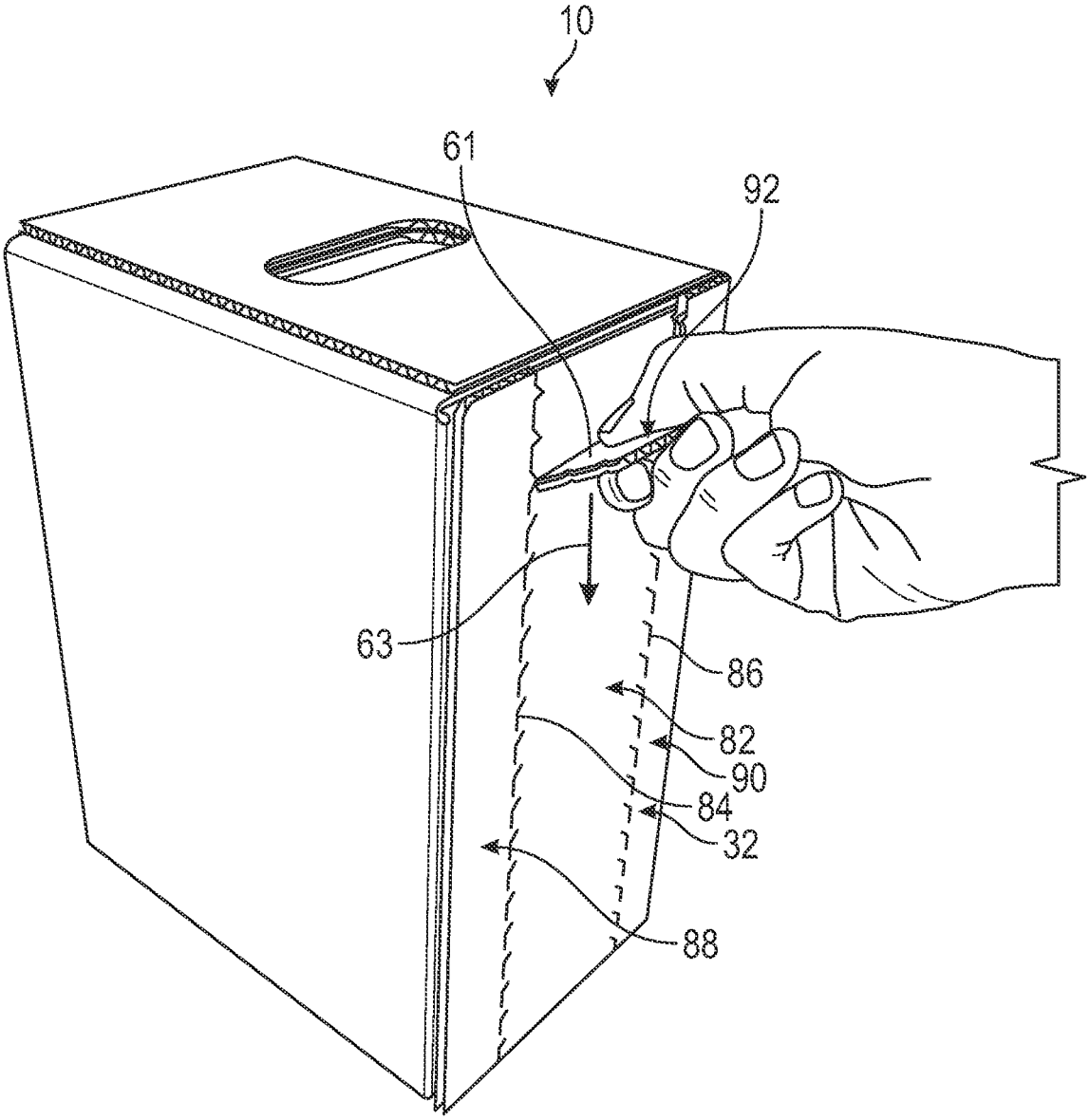
FIG. 8 is a perspective view of the container of FIG. 1 illustrating separation of the removable portion from the outer front wall panel.
Figure 9:
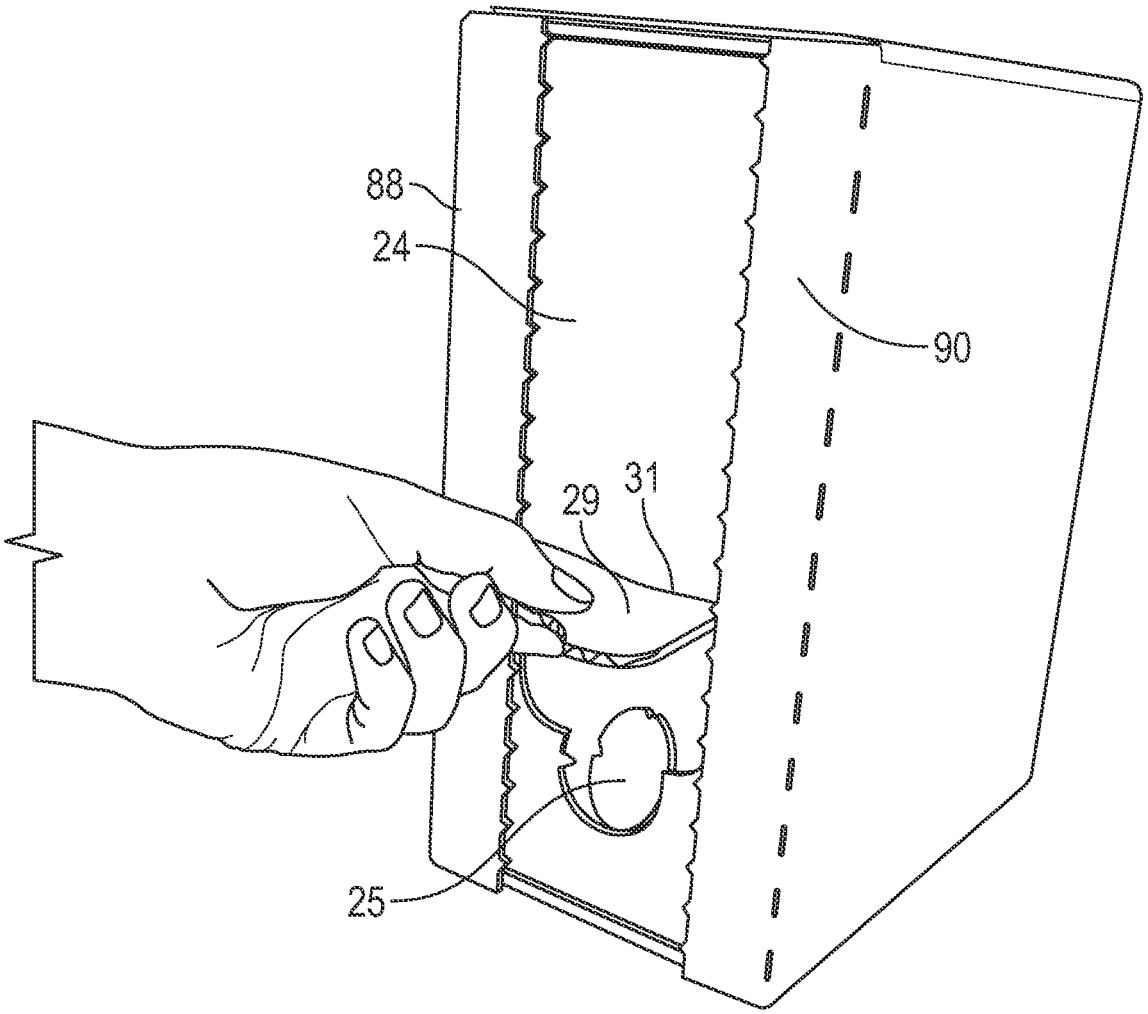
FIG. 9 is a perspective view of the container of FIG. 1 illustrating creation of the spout-receiving opening in the inner front wall panel and the locking portion of the inner front wall panel.
Figure 10:
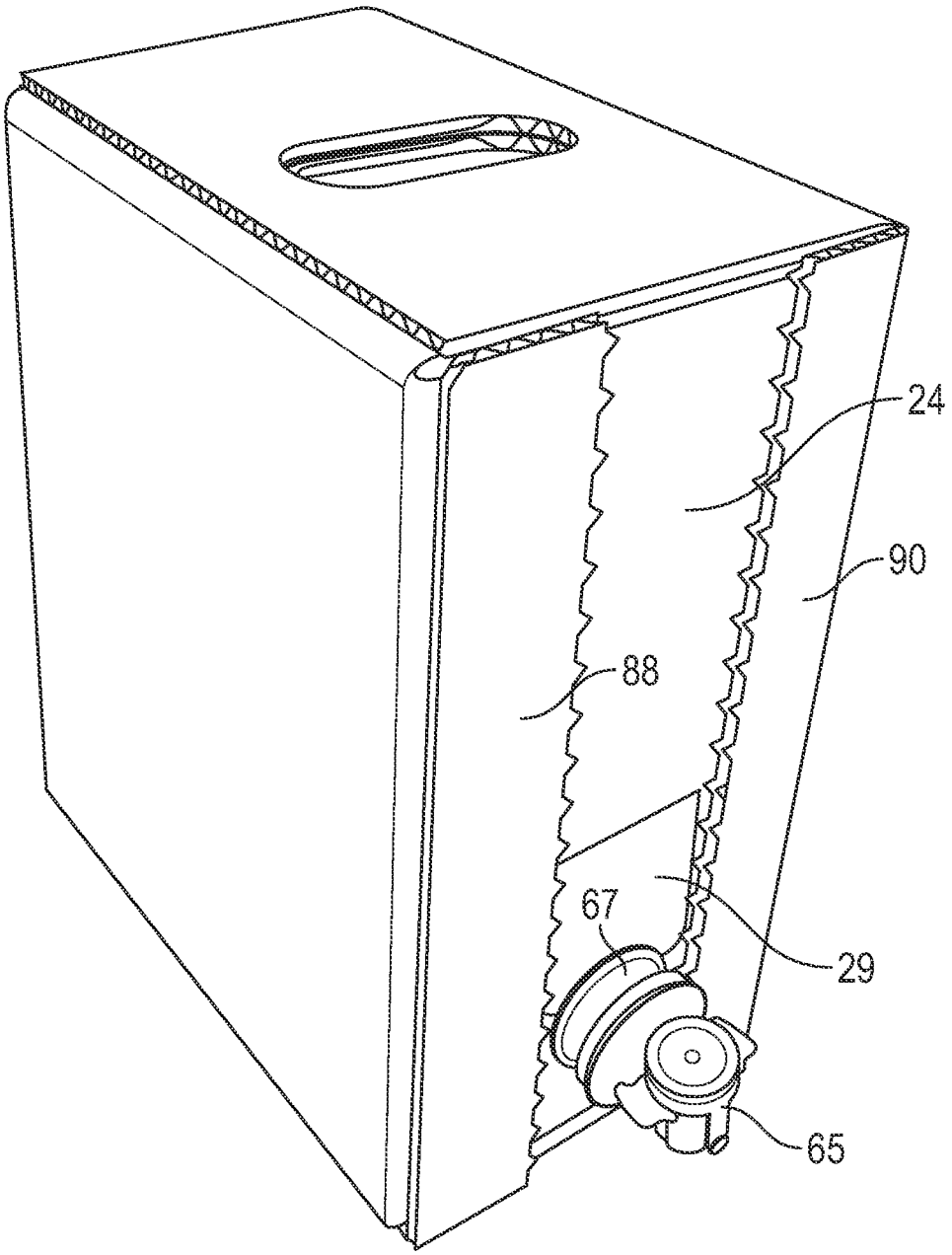
FIG. 10 is a perspective view of the container of FIG. 1 with a spout of a liquid container positioned in the spout-receiving opening of the inner front wall panel and held in place by the locking portion.

FIGS. 8-10 illustrate the steps of opening the container 10 to access the spout of the liquid-containing bag inside. Beginning at FIG. 8, a user can grip the grip portion 92 of the removable portion 82 on the outer front wall panel 32, and bend/pivot/buckle the upper portion of the removable portion 82 downwardly about the fold line 94 (FIG. 2) to form a tab 61. The formation of the tab 61 can concentrate the user's force at the next perforation to be broken along the perforated lines 84 and 86. The outwardly extending tab 61 can also prevent the removable portion 82 from bulging or curving outwardly when pulled, thereby facilitating removal. The remainder of the removable portion 82 can be separated from the outer front wall panel 32 by pulling the tab 61 downwardly in the direction of arrow 63. The removable portion 82 can separate from the outer front wall panel 32 along the perforated lines 84 and 86, leaving the side portions 88 and 90 attached to the inner front wall panel 24, as shown in FIG. 9. This can reveal the removable portion 25 and the locking portion 29 of the inner front wall panel 24.

Still referring to FIG. 9, the removable portion 25 can be separated and removed from the inner front wall panel 24 to create a spout-receiving opening, and the locking portion 29 can be pivoted or folded outwardly about the fold line 31 to access the spout of the liquid-filled bag. Referring to FIG. 10, the spout 65 of the liquid-filled bag can be situated in the spout-receiving opening created by removal of the removable portion 25, and the locking portion 29 can be placed behind the collar 67 of the spout 65 to hold the spout 65 in place.

Figure 12:
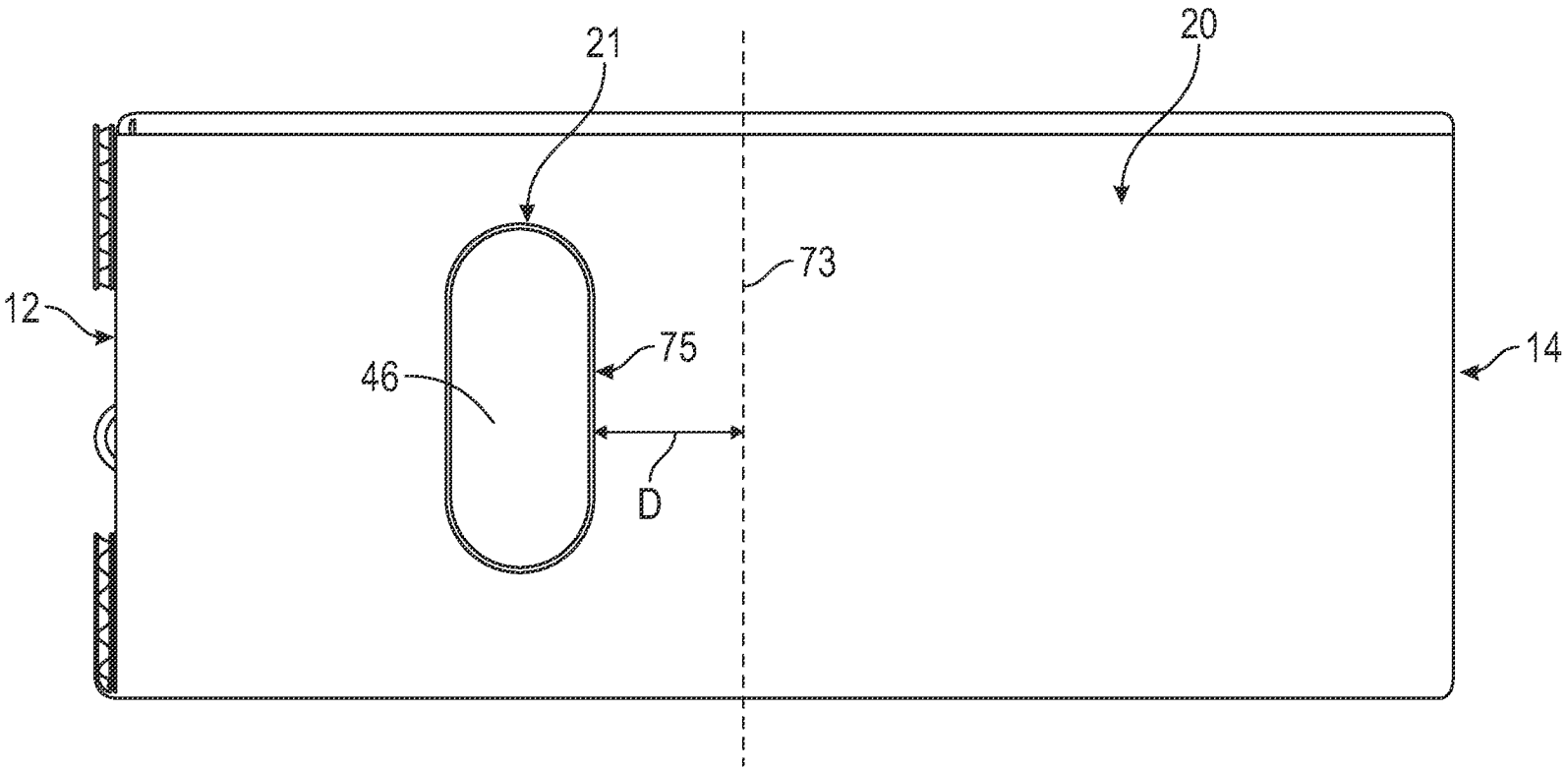
FIG. 12 is a top plan view of a container according to the blank of FIG. 11 showing the handhold offset toward the front wall of the container.
Figure 13:
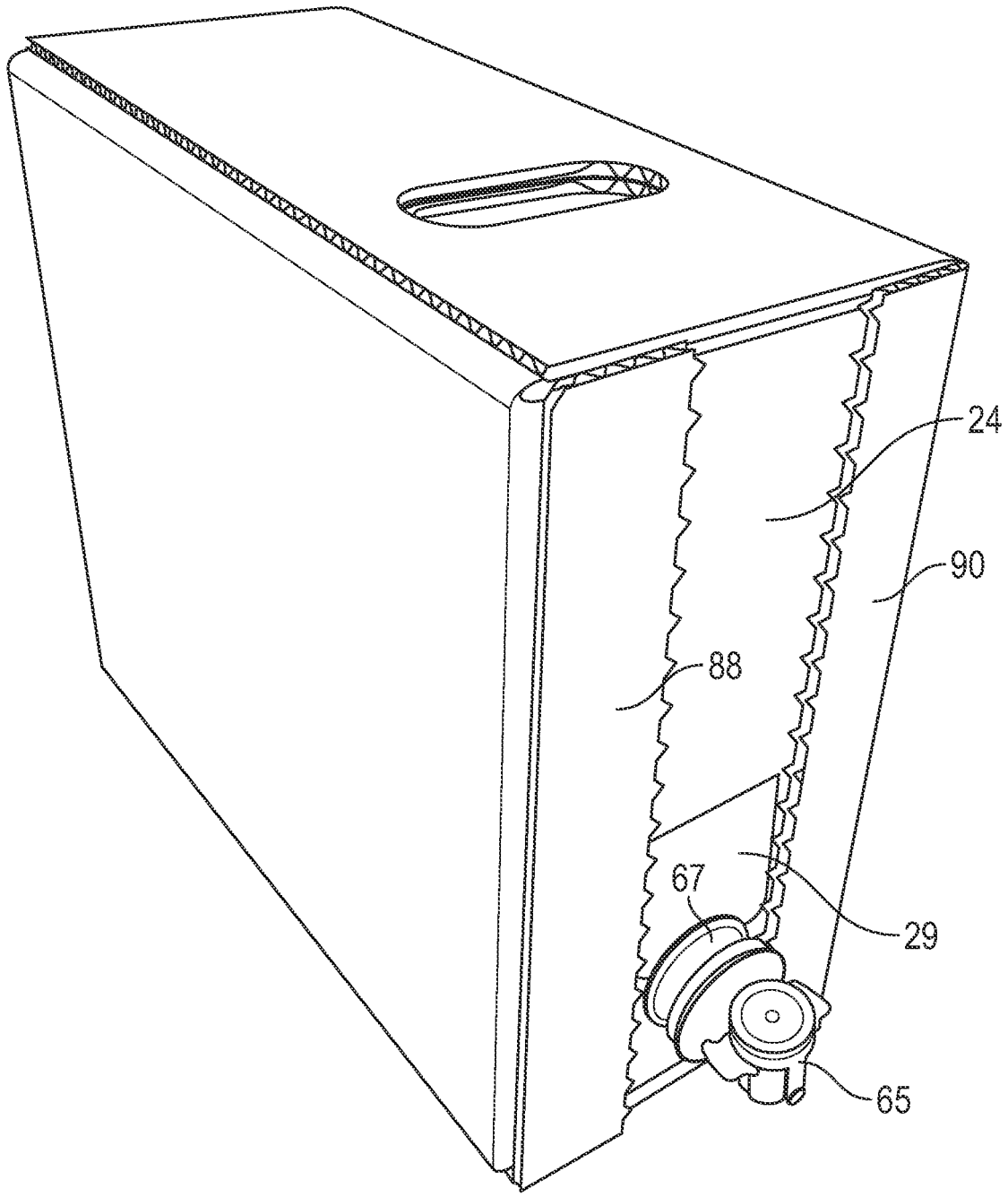
FIG. 13 is a perspective view of a container erected from the blank of FIG. 11 with the removable portion of the outer front wall panel removed and a spout of a liquid container disposed through the inner front wall panel.

FIG. 11 illustrates another embodiment of the blank 100 in which the first and second inner shield flaps 46 and 64 are the same length. The bottom flaps 50 and 68 can also be the same length. In FIG. 11, the handhold opening 62 of the top flap 54 is located closer to the left edge of the top flap 54 than to the right edge (e.g., offset from the center of the flap 54 toward the left edge). When erected, this means that the handhold opening 62 is offset from the center of the top flap 54 toward the front wall 12 of the container. The handhold opening 76 of the top flap 72 can be offset to toward the right edge of the top flap 72 in FIG. 11. When erected, this means that the handhold opening 76 aligns with the handhold opening 62, and is also offset from the center of the top flap 72 toward the front wall 12 of the container. Thus, referring to FIG. 12, when the container is erected the handhold opening 21 is positioned closer to the front wall 12 than to the rear wall 14. Dashed line 73 indicates the location of the free distal edge of the first inner shield flap 46. Edge 75 is the edge of the handhold 21 nearest the free distal edge of the first inner shield flap 46. Thus, a distance D is maintained between the edge 75 of the handhold 21 nearest the free distal edge of the first inner shield flap 46 and the free distal edge of the first inner shield flap 46, similar to the relationship described above with reference to FIG. 6. In the embodiment of FIGS. 11 and 12, the separation distance D between the edge 75 of the handhold 21 and the free distal edge of the first inner shield flap 46 is created by locating the handhold 21 closer to the front wall 12 than to the rear wall 14 in combination with inner shield flaps of approximately equal length. A similar relationship between the handhold 21 and the second inner shield flap 64 can be accomplished by locating the handhold 21 closer to the rear wall 14 than to the front wall 12. FIG. 13 is a perspective view of a container erected from the blank 100 of FIG. 11, and with the portion 82 of the outer front wall panel 32 removed and the spout of a liquid bag disposed through the inner front wall panel 24.

In certain embodiments, any of the container configurations described herein can be covered or wrapped in a polymeric film, such as a heat-shrink film, after the liquid-containing bag is inserted into the container and the container is closed. In certain embodiments, the polymeric film can cover the handhold 21. The polymeric film can provide additional impact strength to the container, which can allow the container to be made from lower Mullen (burst) test strength corrugated paperboard and/or lower edge crush test (ECT) strength corrugated paperboard, reducing cost and weight. The polymeric film can also protect the surface of the container, labels and/or graphics thereon, and prevent the accumulation of dirt in the handhold opening during shipment or storage, improving the aesthetic appeal of the container after removing the film. The film can also prevent use of the handhold 21 by delivery personnel, improving cleanliness and aesthetic appeal. In certain embodiments, the polymeric film can be partially transparent or opaque. This can obscure the nature of the product in the container, which can help to reduce the risk of theft when the container is delivered to a customer in a non-secure location, such as on the porch of a house.

In certain embodiments, the containers described herein can comprise any of various coatings on the interior and/or exterior surfaces to impart particular properties. For example, the container can include anti-abrasive coatings (e.g., polytetrafluorethylene (PTFE)), hydrophobic or water-repellant coatings, and/or antistatic coatings to reduce the buildup of electric charge. Any of the coatings described herein can be combined in various layers and/or mixtures according to the particular properties sought, or as specified for a particular application.

The container embodiments described can provide a number of significant advantages over existing containers for housing liquid-filled bags. For example, the overlapping inner and outer front wall panels can impart improved impact strength to the front of the container, with the outer front wall panel protecting the removable panels of the inner front wall panel. The outer front wall panel can also protect against the liquid-filled bag bursting through the removable panel and/or the locking panel of the inner front wall panel if the container is dropped.

The removable portion of the outer front wall panel provides user-friendly access to the inner front wall panel. Securing the side portions of the outer front wall panel to the inner front wall panel improves the user's ability to pull the removable portion downwardly (or upwardly) during removal. The grip portion and fold line on the removable portion also provide leverage. In particular, the fold line allows not only the formation of a pull tab on the removable portion, but also acts to concentrate the user's force at one perforation at a time along the perforated lines 84 and 86. This allows the removable portion to be removed from the outer front wall panel relatively easily, and without causing the removable portion to bow or bulge outwardly. Such bowing can otherwise impede removal of the removable portion because the user's effort results in deformation of the panel rather than detachment, which can be an issue particularly on wide panels. Thus, this combination of features allows the removable portion to be relatively wide, such as 20%, 30%, 40%, 50% or more of the overall width of the outer front wall panel, and still be relatively easy to detach.

Additionally, configuring the top of the container as described herein such that the handhold is offset from the free edges of the inner shield flaps prevents the user's hand from directly touching the liquid-containing bag inside the container, allows the inner shield flaps to pivot to accommodate the user's hand and provide a more comfortable handhold, and also maintains a flat top surface of the container to facilitate stacking, etc.

Explanation of Terms

For purposes of this description, certain aspects, advantages, and novel features of the embodiments of this disclosure are described herein. The disclosed methods, apparatus, and systems should not be construed as being limiting in any way. Instead, the present disclosure is directed toward all novel and nonobvious features and aspects of the various disclosed embodiments, alone and in various combinations and sub-combinations with one another. The methods, apparatus, and systems are not limited to any specific aspect or feature or combination thereof, nor do the disclosed embodiments require that any one or more specific advantages be present or problems be solved.

Although the operations of some of the disclosed embodiments are described in a particular, sequential order for convenient presentation, it should be understood that this manner of description encompasses rearrangement, unless a particular ordering is required by specific language set forth herein. For example, operations described sequentially may in some cases be rearranged or performed concurrently. Moreover, for the sake of simplicity, the attached figures may not show the various ways in which the disclosed methods can be used in conjunction with other methods.

As used in this disclosure and in the claims, the singular forms "a," "an," and "the" include the plural forms unless the context clearly dictates otherwise. Additionally, the term "includes" means "comprises." Further, the terms "coupled" and "associated" generally mean electrically, electromagnetically, and/or physically (e.g., mechanically or chemically) coupled or linked and does not exclude the presence of intermediate elements between the coupled or associated items absent specific contrary language.

In some examples, values, procedures, or apparatus may be referred to as "lowest," "best," "minimum," or the like. It will be appreciated that such descriptions are intended to indicate that a selection among many alternatives can be made, and such selections need not be better, smaller, or otherwise preferable to other selections.

In the description, certain terms may be used such as "up," "down," "upper," "lower," "horizontal," "vertical," "left," "right," and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object.

Unless otherwise indicated, all numbers expressing dimensions and so forth as used in the specification or claims are to be understood as being modified by the term "about." Accordingly, unless otherwise indicated, implicitly or explicitly, the numerical parameters set forth are approximations that can depend on the desired properties sought and/or limits of detection under test conditions/methods familiar to those of ordinary skill in the art. When directly and explicitly distinguishing embodiments from discussed prior art, the embodiment numbers are not approximates unless the word "about" is recited.

Although there are alternatives for various components, dimensions, parameters, operating conditions, etc., set forth herein, that does not mean that those alternatives are necessarily equivalent and/or perform equally well. Nor does it mean that the alternatives are listed in a preferred order unless stated otherwise.

In view of the many possible embodiments to which the principles of the disclosed technology may be applied, it should be recognized that the illustrated embodiments are only preferred examples and should not be taken as limiting the scope of the disclosure. Rather, the scope of the disclosure is at least as broad as the following claims and their equivalents. We therefore claim all that comes within the scope and spirit of these claims.

The invention claimed is:

1. A container for housing a liquid-filled bag with a spout, comprising:

a container bottom;

at least four walls extending upwardly from the container bottom, the at least four walls including first and second side walls, a front wall, and a back wall;

the front wall comprising a removable portion configured to define a spout-receiving opening when the removable portion is removed;

the front wall and the back wall being opposed and spaced apart from each other along a length dimension of the container;

the first side wall comprising a first side wall panel, and the second side wall comprising a second side wall panel;

the front wall comprising a front wall panel, and the back wall comprising a back wall panel, the back wall panel being interconnected with the first and second side wall panels;

a first inner shield flap coupled to the front wall panel;

a second inner shield flap coupled to the back wall panel;

a first top flap coupled to the first side wall panel, the first top flap defining a first handhold opening;

a second top flap coupled to the second side wall panel, the second top flap defining a second handhold opening;

wherein the second handhold opening and the first handhold opening overlap to define a handhold when the second top flap is folded over the first top flap; and wherein the first top flap and the second top flap are on top of the first inner shield flap and on top of the second inner shield flap, and the handhold is offset from free end portions of the first and second inner shield flaps along the length dimension of the container.

2. The container of claim 1, wherein the first and second inner shield flaps have different lengths such that the free end portions of the first and second inner shield flaps are closer to the front wall than to the back wall, or closer to the back wall than to the front wall.

3. The container of claim 1, wherein the first inner shield flap is longer than the second inner shield flap such that the free end portions of the first and second inner shield flaps are closer to the back wall than to the front wall.

4. The container of claim 1, wherein the handhold is closer to the front wall than to the back wall.

5. The container of claim 1, wherein the handhold is closer to the back wall than to the front wall.

6. The container of claim 1, wherein:

the handhold overlays the first inner shield flap;

the first inner shield flap comprises a free distal edge; and a distance between the free distal edge of the first inner shield flap and an edge of the handhold nearest to the free distal edge of the first inner shield flap is 0.75 inch or more.

7. The container of claim 1, wherein:

the front wall panel is an inner front wall panel;

the container further comprises an outer front wall panel coupled to the second side wall panel and overlapping the inner front wall panel; and the outer front wall panel comprises a removable portion configured to expose the inner front wall panel when removed.

8. The container of claim 7, wherein:

the outer front wall panel further comprises a first side portion secured to the inner front wall panel and a second side portion secured to the inner front wall panel; and the removable portion of the outer front wall panel is between the first side portion of the outer front wall panel and the second side portion of the outer front wall panel.

9. The container of claim 8, wherein the first side portion and the second side portion of the outer front wall panel are adhered to the inner front wall panel, and the removable portion of the outer front wall panel is not adhered to the inner front wall panel.

10. The container of claim 8, wherein the outer front wall panel comprises a first perforated line between the first side portion and the removable portion of the outer front wall panel, and a second perforated line between the second side portion and the removable portion of the outer front wall panel, and the first perforated line and the second perforated line extend from an upper edge of the outer front wall panel to a lower edge of the outer front wall panel.

11. The container of claim 10, wherein the first perforated line and the second perforated line are angled relative to a longitudinal axis of the outer front wall panel.

12. The container of claim 8, wherein a width of the first side portion is inch or more, and wherein a width of the second side portion is 0.75 inch or more.

13. The container of claim 7, wherein the removable portion of the outer front wall panel comprises a grip portion at a top edge of the removable portion of the outer front wall panel.

14. The container of claim 7, wherein the removable portion of the outer front wall panel comprises a fold line extending across a width of the removable portion of the outer front wall panel.

15. The container of claim 7, wherein a width of the removable portion of the outer front wall panel is 25% or more of a width of the outer front wall panel.

16. The container of claim 1, wherein the container is wrapped in a polymeric film.

17. The container of claim 1, wherein:

the front wall panel is an inner front wall panel;

the container further comprises an outer front wall panel coupled to the second side wall panel and overlapping the inner front wall panel; and the container further comprises a tab member coupled to the inner front wall panel, and the tab member is adhered to an inside surface of the second side wall panel.

18. The container of claim 1, wherein the first inner shield flap and the second inner shield flap are freely pivotable downwardly into the container.

19. A container for housing a liquid-filled bag with a spout, comprising:

a container bottom;

at least four walls extending upwardly from the container bottom, the at least four walls including first and second side walls, a front wall, and a back wall;

the front wall and the back wall being opposed and spaced apart from each other along a length dimension of the container;

the first side wall comprising a first side wall panel, and the second side wall comprising a second side wall panel;

the front wall comprising an inner front wall panel coupled to the first side wall panel, and an outer front wall panel coupled to the second side wall panel and overlapping the inner front wall panel, the inner front wall panel comprising a removable portion configured to define a spout-receiving opening when removed;

the back wall comprising a back wall panel, the back wall panel being interconnected with the first and second side wall panels; and wherein the outer front wall panel comprises a removable portion configured to expose the inner front wall panel when removed, the outer front wall panel further comprising a first side portion secured to the inner front wall panel and a second side portion secured to the inner front wall panel, and wherein the removable portion of the outer front wall panel is between the first side portion and the second side portion; and wherein the outer front wall panel comprises a first perforated line between the first side portion and the removable portion of the outer front wall panel, and a second perforated line between the second side portion and the removable portion of the outer front wall panel, and wherein the first perforated line and the second perforated line extend from an upper edge of the outer front wall panel to a lower edge of the outer front wall panel.

20. The container of claim 19, wherein the first side portion and the second side portion of the outer front wall panel are adhered to the inner front wall panel, and the removable portion of the outer front wall panel is not adhered to the inner front wall panel.

21. The container of claim 19, wherein the first perforated line and the second perforated line are angled relative to a longitudinal axis of the outer front wall panel.

22. The container of claim 19, wherein the removable portion of the outer front wall panel comprises a grip portion at a top edge of the removable portion of the outer front wall panel.

23. The container of claim 19, wherein the removable portion of the outer front wall panel comprises a fold line extending across a width of the removable portion of the outer front wall panel.

24. The container of claim 19, wherein a width of the removable portion of the outer front wall panel is 25% or more of a width of the outer front wall panel.

25. The container of claim 19, wherein a width of the first side portion is 0.75 inch or more, and wherein a width of the second side portion is 0.75 inch or more.

26. The container of claim 19, wherein the container further comprises:

a first inner shield flap coupled to the inner front wall panel;

a second inner shield flap coupled to the back wall panel;

a first top flap coupled to the first side wall panel, the first top flap defining a first handhold opening;

a second top flap coupled to the second side wall panel, the second top flap defining a second handhold opening;

wherein the second handhold opening and the first handhold opening overlap to define a handhold when the second top flap is folded over the first top flap; and wherein the handhold is spaced apart from free end portions of the first and second inner shield flaps along the length dimension of the container.

27. The container of claim 19, wherein the container is wrapped in a polymeric film.

28. A container for housing a liquid-filled bag with a spout, comprising:

a container bottom;

at least four walls extending upwardly from the container bottom, the at least four walls including first and second side walls, a front wall, and a back wall;

the front wall and the back wall being opposed and spaced apart from each other along a length dimension of the container;

the first side wall comprising a first side wall panel, and the second side wall comprising a second side wall panel;

the front wall comprising an inner front wall panel coupled to the first side wall panel, and an outer front wall panel coupled to the second side wall panel and overlapping the inner front wall panel, the inner front wall panel comprising a removable portion configured to define a spout-receiving opening when removed;

the back wall comprising a back wall panel, the back wall panel being interconnected with the first and second side wall panels;

a first inner shield flap coupled to the inner front wall panel;

a second inner shield flap coupled to the back wall panel;

a first top flap coupled to the first side wall panel, the first top flap defining a first handhold opening;

a second top flap coupled to the second side wall panel, the second top flap defining a second handhold opening;

wherein the second handhold opening and the first handhold opening overlap to define a handhold when the second top flap is folded over the first top flap, the first top flap and the second top flap are on top of the first inner shield flap and on top of the second inner shield flap, and the handhold is offset from free end portions of the first and second inner shield flaps along the length dimension of the container; and wherein the outer front wall panel comprises a removable portion configured to expose the inner front wall panel when removed.

29. The container of claim 28, wherein the handhold is closer to the front wall than to the back wall.

* * * * *